US006742655B2

(12) United States Patent
Kasakura

(10) Patent No.: US 6,742,655 B2
(45) Date of Patent: Jun. 1, 2004

(54) CUSHIONING MATERIAL AND CONTAINER ALSO SERVING FOR CUSHIONING USING THE CUSHIONING MATERIAL AS CONTAINER

(76) Inventor: Yoshimasa Kasakura, 234-12, Sashima, Kawaguchi-shi, Saitama 333-0816 (JP)

( * ) Notice: Subject to any disclaimer, the term of this patent is extended or adjusted under 35 U.S.C. 154(b) by 4 days.

(21) Appl. No.: 09/834,692

(22) Filed: Apr. 13, 2001

(65) Prior Publication Data

US 2001/0030141 A1 Oct. 18, 2001

(30) Foreign Application Priority Data

| | | |
|---|---|---|
| Apr. 14, 2000 | (JP) | 2000-002437 |
| Jun. 2, 2000 | (JP) | 2000-003762 |
| Oct. 5, 2000 | (JP) | 2000-007173 |

(51) Int. Cl.[7] ..... B65D 81/02
(52) U.S. Cl. ..... 206/592; 206/523; 220/592.26

(58) Field of Search ..... 206/523, 589, 206/590, 592, 594; 220/592.26, 592.25

(56) References Cited

U.S. PATENT DOCUMENTS

| | | | | | |
|---|---|---|---|---|---|
| 3,338,542 | A | * | 8/1967 | Meinhard | 248/345.1 |
| 3,768,724 | A | * | 10/1973 | Hill | 206/523 |
| 4,823,945 | A | * | 4/1989 | Adelman | 206/204 |
| 5,129,519 | A | * | 7/1992 | David et al. | 206/523 |
| 5,139,151 | A | * | 8/1992 | Chelak | 206/523 |
| 5,176,930 | A | * | 1/1993 | Kannankeril et al. | 426/124 |
| 5,620,096 | A | * | 4/1997 | Pozzo | 206/450 |

* cited by examiner

*Primary Examiner*—Mickey Yu
*Assistant Examiner*—Troy Arnold
(74) *Attorney, Agent, or Firm*—Flynn, Thiel, Boutell & Tanis, P.C.

(57) ABSTRACT

A cushioning member formed by stacking a plurality of sheet-like cushioning materials and surrounding the periphery of the cushioning materials with a sheet-like member.

13 Claims, 12 Drawing Sheets

(a)

(b)

(a)

(b)

CUSHIONING MATERIAL AND CONTAINER ALSO SERVING FOR CUSHIONING USING THE CUSHIONING MATERIAL AS CONTAINER

BACKGROUND OF THE INVENTION

1. Field of the Invention

This invention concerns a cushioning material and a container also serving for cushioning using the cushioning material as a container.

2. Description of the Related Art

Various cushioning devises have been adopted so far such as cushioning devices interposed between articles for preventing the articles from direct contact with each other, or cushioning devices disposed between a container and an article for preventing various kinds of articles contained in the container from being damaged by external impact shocks. The cushioning materials adopted so far include, for example, those of plastic molding products such as formed styrol, cushioning members made of shaped paper products such as corrugated boards, cushioning members utilizing containing forms molded along with the profile of articles, or sheet-like cushioning members such as foamed cushioning sheets or air-sealed cushioning sheets made of synthetic resins.

In any of the cushioning members described above, thick cushioning members have to be formed in order to obtain effective cushioning members but integrally molded thick products are expensive when used as the cushioning members. Further, for obtaining cushioning members of predetermined thickness from relatively inexpensive sheet-like cushioning members, a method has been adopted, for example, of using the sheets by merely stacking them in plurality, or using the stacked sheets by connecting them to each other.

The former has a worry that the stacked sheets are disintegrated by impact shocks and the latter requires adhering the sheets one by one to each other.

This invention intends to provide a thick cushioning member by stacking a plurality of sheet-like cushioning materials as described above to define a cushioning material and covering the same entirely with a sheet-like member into a single cushioning member.

Also, this invention intends to provide a container also serving for cushioning in which the cushioning member formed as described above is used itself as a container, not requiring any container.

Further, this invention uses sheet-like cushioning materials instead of integrally molded products of predetermined thickness to define the cushioning members, and it intends to provide a cushioning member formed by stacking a plurality of sheet-like synthetic resin cushioning materials into a laminate without adhering the cushioning materials one by one to each other such that at once, by the covering, a laminated cushioning member is still obtained comprising cushioning materials connected with each other in a predetermined thickness.

Further, when plate-like products which are relatively thin and sensitive to impact shocks such as substrates for electronic parts are contained and transported, the products may possibly abut against each other to be damaged, such that the products have been contained in a containing device having partition plates formed by considering the size or the like of the products. As a result, a predetermined gap is formed between each of the products in order to prevent contact between each of the products.

In this case, since the substrates for electronic parts are precision products and sensitive to impact shocks, cushioning members have been disposed separately also between the partition plates or in vertical gaps between the products, in addition to the containing member for partitioning the products such that no direct impact is applied to the products.

Further, depending on the products tending to cause damages, they are individually packaged with flexible materials.

As described above, when plate-like products which are relatively thin and sensitive to impact shocks such as substrates for electronic parts are contained and transported, a partitioned containing body is previously formed for containing products, or such products are contained individually. This requires separately preparing a containing body having partitioning plates or individual containing devices, which increases the cost.

Further, since the partitioning function is considered more important for the partitioning plates having a cushioning function by themselves, the partitioning plate has a rigidity to some extent and has no sufficient cushioning function. Furthermore, a member both having the partitioning function and the cushioning function is expensive, which increases the material cost.

SUMMARY OF THE INVENTION

This invention intends to provide a sheet-like cushioning member having a partitioning function as a containing member for partitioning and containing products, as well as having a sufficient cushioning function and an extremely reduced cost.

This invention also intends to provide a cushioning member also serving for partitioning which cushioning member is formed by partially collapsing an air layer of a member having a plurality of air layers each comprising a small chamber surrounded with a soft material to form a concave portion, and using the concave portion as a space for containing a relatively thin plate-like product.

Further, according to this invention, when a plurality of sheet-like cushioning materials are stacked into a laminate, unevenness is formed by stacking cushioning materials of different sizes while making the number of sheets different and the concave portion is used as a containing portion for an article. In this case, it is possible to contain an article having more thickness compared with that of the constitution described above.

Further, the sheet-like cushioning members can be connected to each other by covering the periphery of the laminate and the inner wall surface of through holes formed from an upper layer to a lower layer of the laminate with a sheet-like member.

This invention provides a cushioning material and a container also serving for cushioning using, as a container, a cushioning member formed by disposing a plurality of sheet-like cushioning materials between a somewhat thick sheet-like member as a lower layer and a soft sheet-like member as an upper layer, connecting the sheets for the upper and the lower layers at appropriate positions such as circumferential edges to form a cushioning member and, further, forming an article disposing portion for containing an article in the cushioning member to form a container.

Further, this invention provides a cushioning member formed by stacking a plurality of sheet-like cushioning materials into a laminate and fusing the laminate at a portion of the lateral side or at through holes passing through the laminate from an upper layer to a lower layer to form a laminate in which cushioning materials are integrally connected with each other.

This invention further provides a cushioning member formed by collapsing a portion of an air layer of a member in which the air layer is surrounded with a soft material to form a concave portion and using the concave portion as a space for containing a relatively thin plate-like product.

Further, this invention provides a cushioning member formed by stacking cushioning materials of different sizes while making the number of stacked sheets different to form unevenness, using the concave portion as a containing portion of a relatively thick article, forming through holes passing from an upper layer to lower layer in the laminate, and surrounding the periphery of the laminate and the inner wall surface of through holes with a sheet-like member.

DESCRIPTION OF THE PREFERRED EMBODIMENTS

In Example 1 of this invention, a plurality of sheet-like cushioning materials are laminated and they are covered with a sheet-like member to form a thick cushioning member.

Further, the cushioning member is formed as a container. This invention is explained herein with reference to the example.

Figure 1:
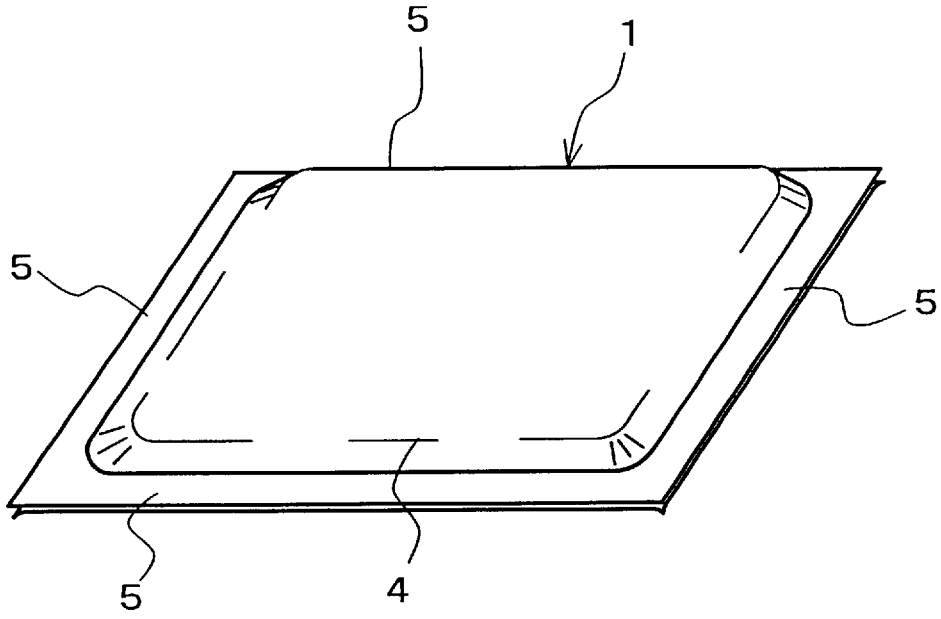
FIG. 1(*a*) is a perspective view of a cushioning member according to this invention and FIG. 1(*b*) is a cross sectional view of a cushioning member according to this invention.
Figure 1:
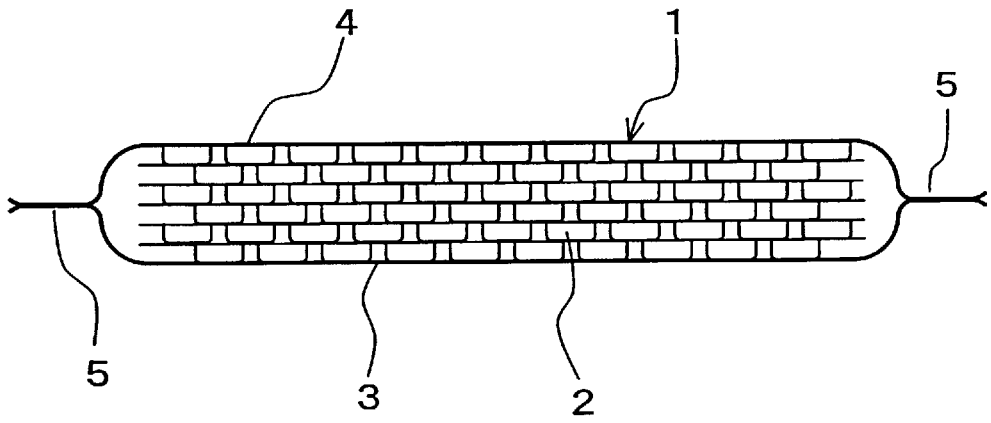

FIG. 1(*a*) is a perspective view of a sheet-like cushioning member 1 and FIG. 1(*b*) is a cross sectional view of a sheet-like cushioning member 1.

The sheet-like cushioning member 1 comprises a cushioning material 2 at a central portion, as well as a sheet-like member 3 as a lower layer and a flexible soft sheet-like member 4 as an upper layer which lower and upper layers surround the cushioning material 2.

As to the cushioning material 2 at the central portion, a plurality of elastic sheet-like materials such as those made of synthetic resin formed with an air layer, for example, an air-sealed sheet-like material (Trade name: Aircap), elastic sheet-like material made of corrugated board or elastic sheet-like material made of foamed material are laminated.

The sheet-like member 3 is disposed as the lower layer to the cushioning material 2 at the central portion. For the sheet-like member 3, various sheet-like members such as synthetic resin sheets, paper sheets, cloths, woven fabrics and non-woven fabrics can be used. The entire shape of the sheet-like cushioning material 1 of this invention can be maintained by using a sheet-like member of an appropriate thickness capable of keeping the shape.

A flexible soft sheet-like member 4 made of synthetic resin is disposed as the upper layer. A soft film of about 0.02 to 0.5 mm thickness is used for the flexible film and the film is shrinkable or stretchable in each direction.

Since the soft sheet-like member 4 is excellent in stretchability/shrinkability as described above, the sheet-like member 4 can conform to an uneven shape and cover an entire surface thereof, e.g. for example, when unevenness for containing an article is formed by removing a portion of the cushioning material 2 at the central portion.

Further, the cushioning member 2 at the central portion and the soft sheet-like member 4 are integrated by appropriate means such as adhesion, fusion and stitching so that they can conform to the uneven configuration and keep this state.

Both of the somewhat thick sheet-like member 3 as the lower layer and the soft sheet-like member 4 as the upper layer are connected at a periphery 5 or at other appropriate positions by appropriate means such as adhesion, fusion and stitching.

A sheet-like cushioning member 1 integrated from the sheet-like member 3 as the lower layer and the flexible soft sheet-like member 4 as the upper layer is formed so as to surround the cushioning material 2 at the central portion by the connection.

Figure 2:
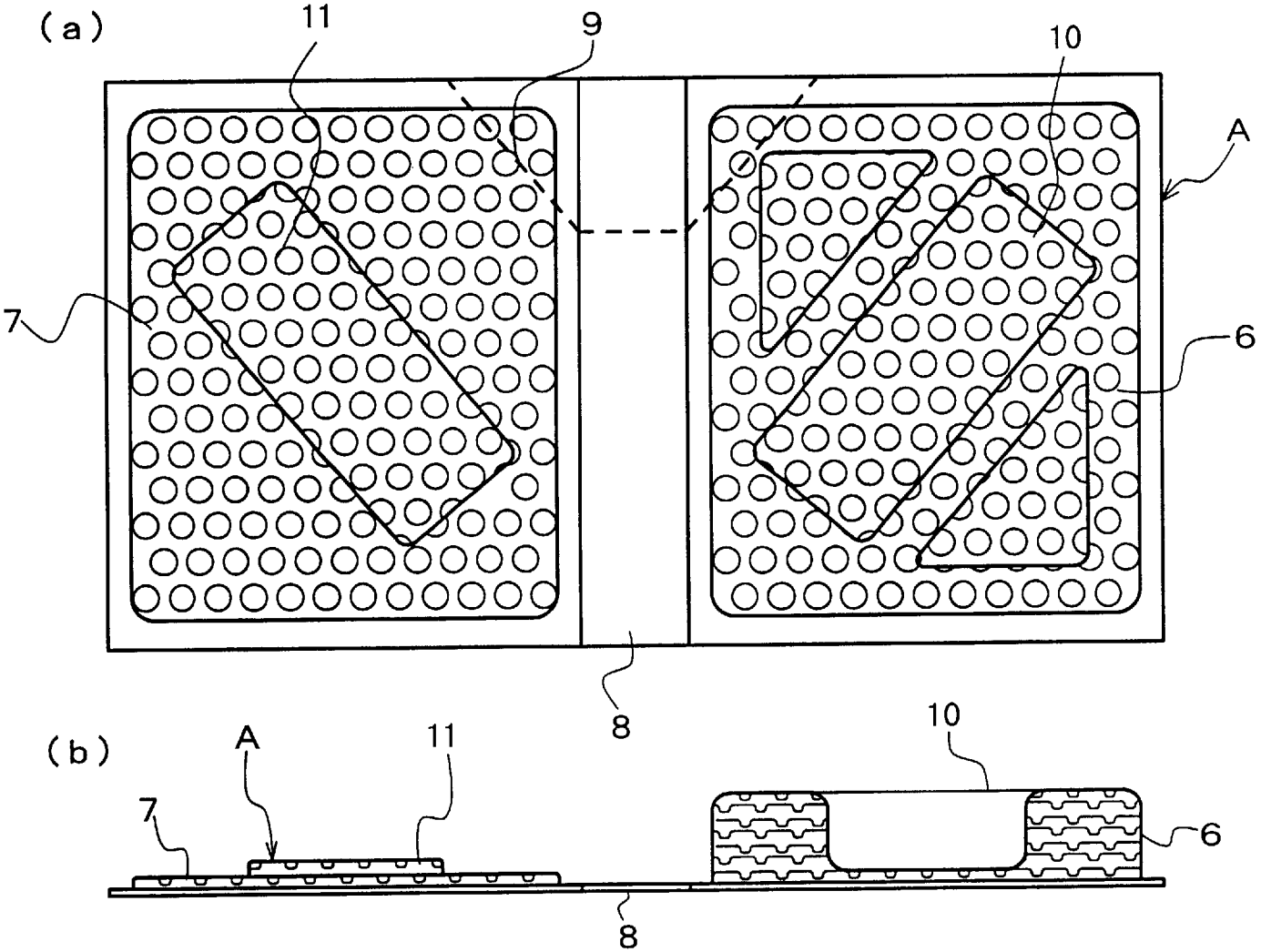
FIG. 2(*a*) is a plan view of a container also serving for cushioning using a cushioning member of this invention as a container and FIG. 2(*b*) is a plan view of a cushioning member also serving for cushioning according to this invention.

FIG. 2(*a*) is a plan view showing a state in which the sheet-like cushioning member 1 is formed as a container A. The container A comprises an article containing portion 6, a lid 7 and a connection portion 8. Further, a corner 9 or the like can optionally be cut. The article containing portion 6 is formed with an article disposing portion 10 that is formed with a concave or recessed portion for containing an article. Further, a protrusion or raised portion 11 is formed in the lid 7 for retaining the article contained in the article disposing portion 10.

As shown in the cross sectional view of FIG. 2(*b*), the entire surface of the cushioning material 2 at the central portion is-covered by the soft sheet-like member 4 along the configuration of the uneven surface of the article disposing portion 10 and the protrusion 11 in the upper layer surface is disposed in the inside of the container A.

When an article is contained and the lid 7 is closed by bending at the connection portion 8, the protrusion 11 formed in the lid 7 situates above the article contained in the article disposing portion 10 to retain and support the article.

In the container A closed by the lid 7, the sheet-like member 3 is made of a somewhat thick synthetic resin sheet, paper sheet, cloth, woven fabric or nonwoven fabric and serves as the outer surface of the cushioning member 1 for maintaining the outer profile.

Figure 3:
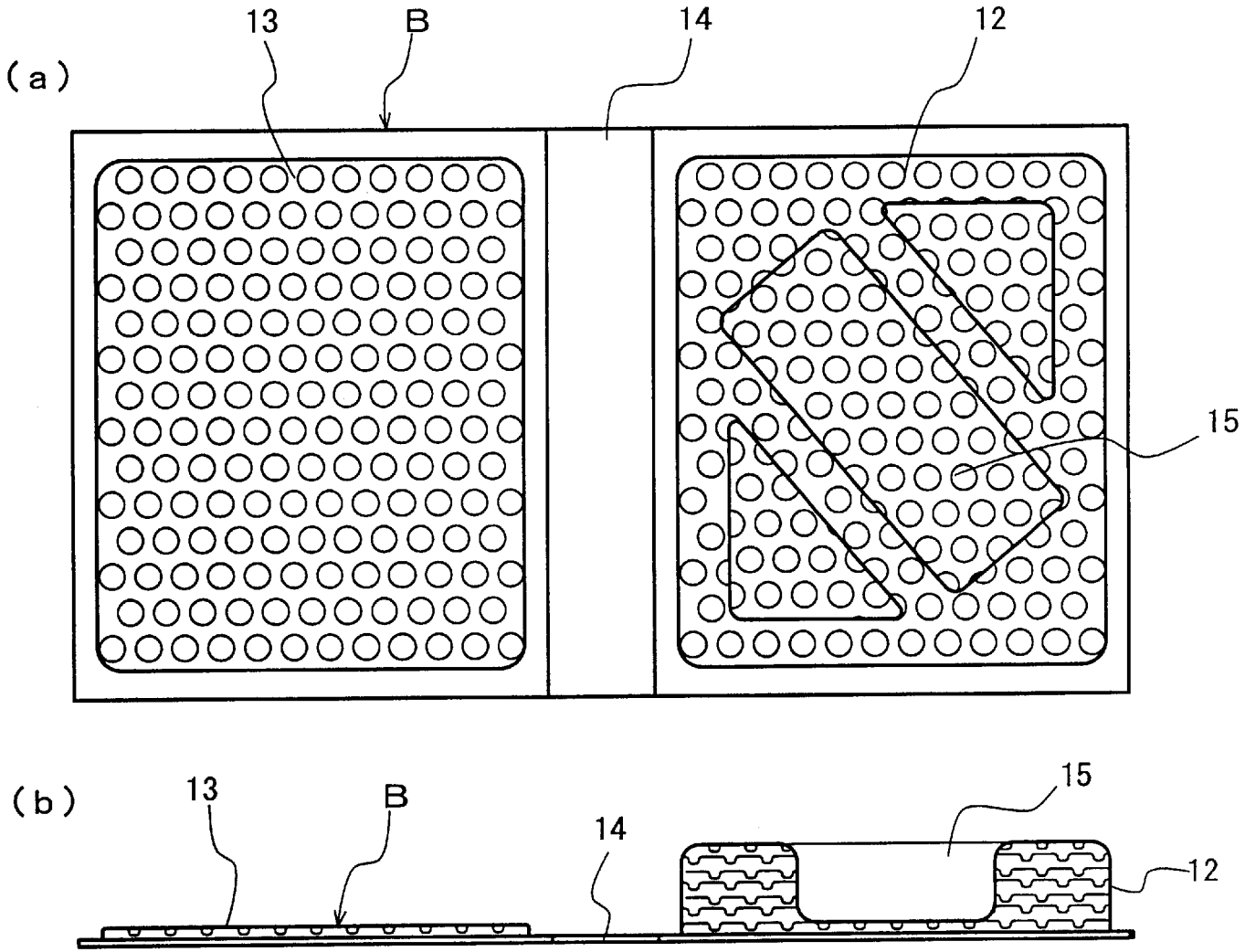
FIG. 3(*a*) is a plan view of another example of a container also serving for cushioning using a cushioning member of this invention as a container and FIG. 3(*b*) is a cross sectional view of another example of a container also serving for cushioning using a cushioning member of this invention as a container.

FIGS. 3(*a*) and 3(*b*) shows another example in a state where a sheet-like cushioning member 1 is formed as a container B like that shown in FIG. 2. FIG. 3(*a*) is a plan view of the container B, while FIG. 3(*b*) is a cross sectional view of the container B. In the container B, a cushioning material 2 is disposed respectively over the paper sheet-like member 3 on the side for an article containing portion 12 and for a lid 13. A connection portion 14 is formed between both of them. An article disposing portion 15 is formed in the article containing portion 12.

The cushioning material 2 and other surface are entirely covered on the upper surface by a soft sheet-like member 4 along the configuration of the uneven surface such as of the article containing portion 12 and the lid 13.

When an article is contained in the article disposing portion 15 and the lid 13 is closed by bending at the connection portion 14, the lid 13 overlaps the surface of the article containing portion 12 and retains the article.

A somewhat thick sheet-like member 3 defines the outer surface of the container B when the lid 13 is closed for maintaining the outer profile thereof.

The following discussion relates to Example 2. In Example 1 described above, the cushioning material is used as a container, so that a containing body not requiring any container can be obtained and a container also serving for cushioning both for cushioning and containing can be obtained.

Figure 4:
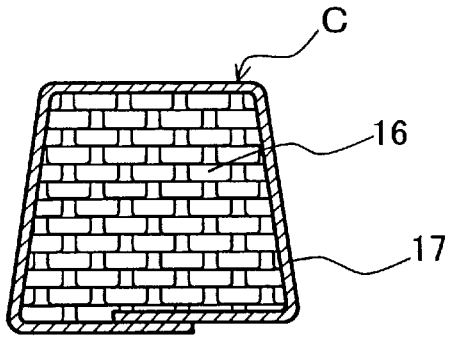
FIG. 4(*a*) is a cross sectional view of a further example of a cushioning member according to this invention and FIG. 4(*b*) is a plan view of a further example of a cushioning member according to this invention.
Figure 4:
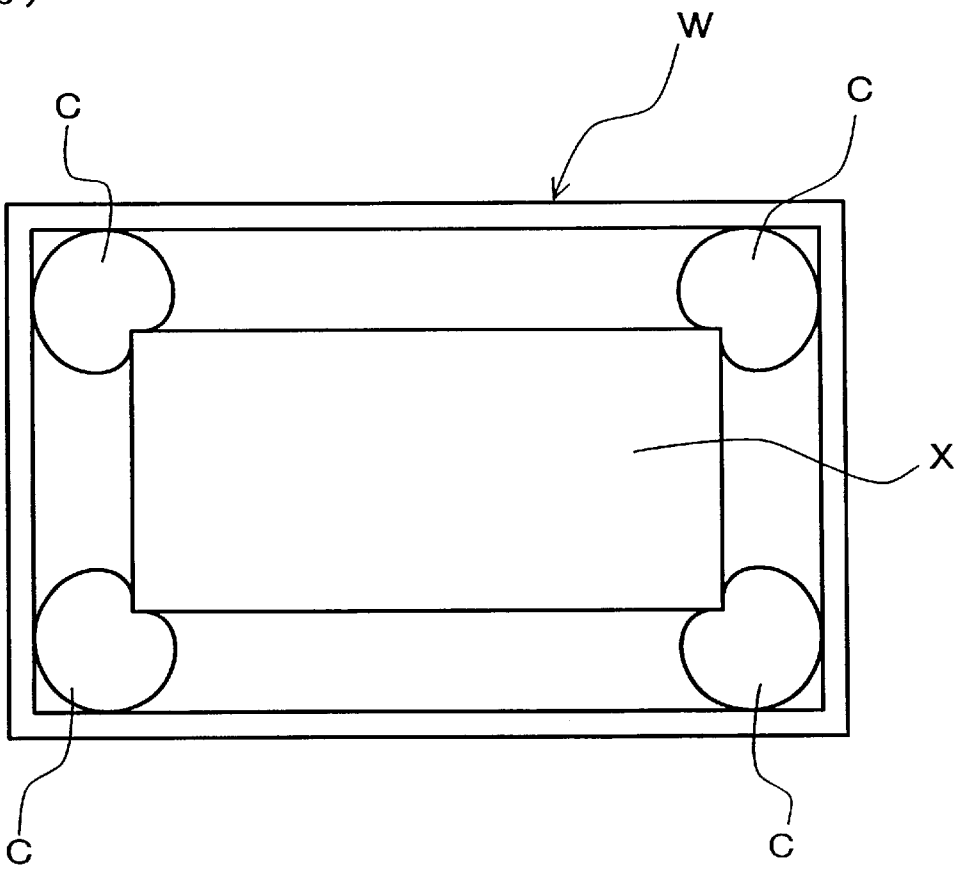

FIG. 4(*a*) is a cross sectional view of sheet-like cushioning materials 16 in a state formed into a thick cushioning member C. As the cushioning material 16, a plurality of elastic sheet-like materials are used such as those made of synthetic resin formed with an air layer, for example, an air-sealed sheet-like material (Trade name: Aircap), elastic sheet-like material made of corrugated board or elastic sheet-like material made of foamed material.

The cushioning material 16 is entirely surrounded with various sheet-like materials 17 such as paper, cloth, woven fabric, non-woven fabric or a soft sheet-like member. Accordingly, an elastic cushioning member can be obtained.

FIG. 4(*b*) is a plan view showing a state in which the cushioning member C is disposed appropriately in a container W such as a corrugate board container in which cushioning members C are located at four corners of the container W and properly support an article X.

In Example 2 described above, the sheet-like cushioning materials used so far individually as the cushioning material are stacked in plurality and they are covered with a sheet-like member into a single cushioning member so as to obtain a thick cushioning member. Further, once used cushioning material can be utilized easily.

In Example 3 of this invention, a cushioning member of a predetermined thickness is obtained by stacking a plurality of sheet-like cushioning materials of synthetic resin into a laminate and by connecting the sheet-like cushioning materials to each other.

Descriptions will be made with reference to the example.

Figure 5:
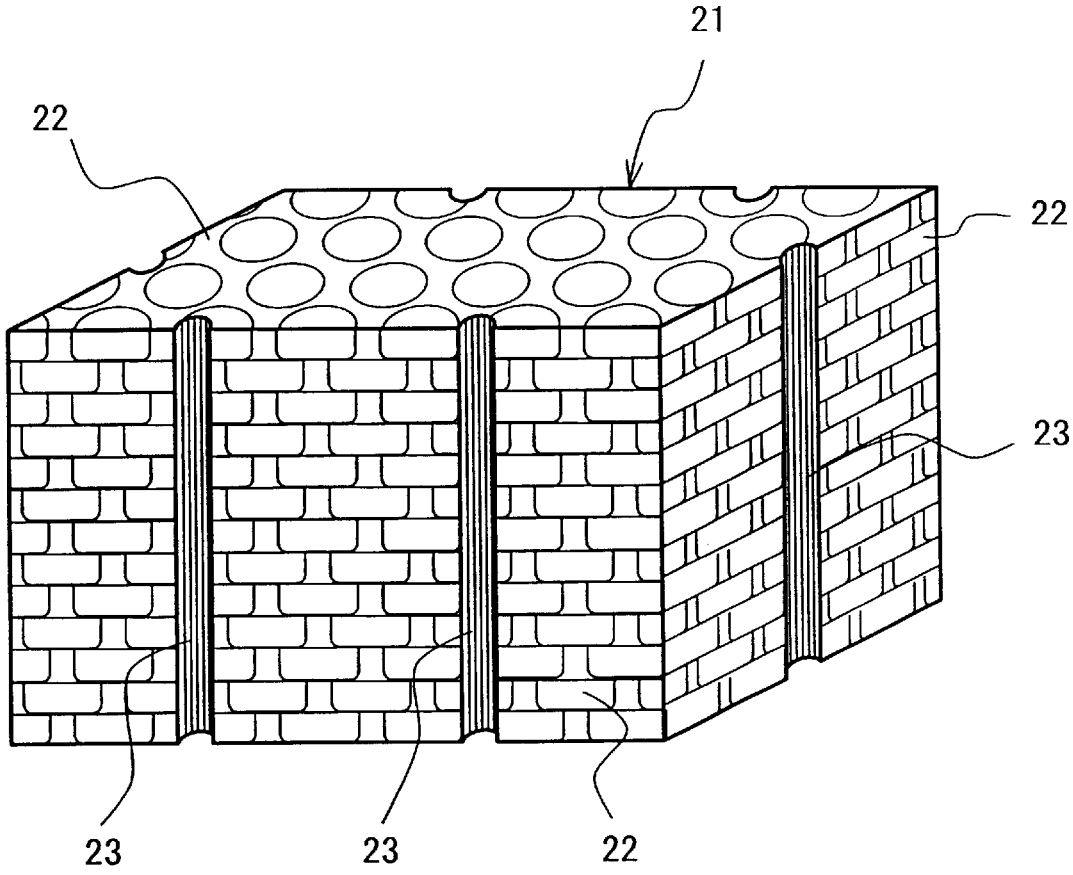
FIG. 5 is a perspective view of a further example of a cushioning member according to this invention.
Figure 6:
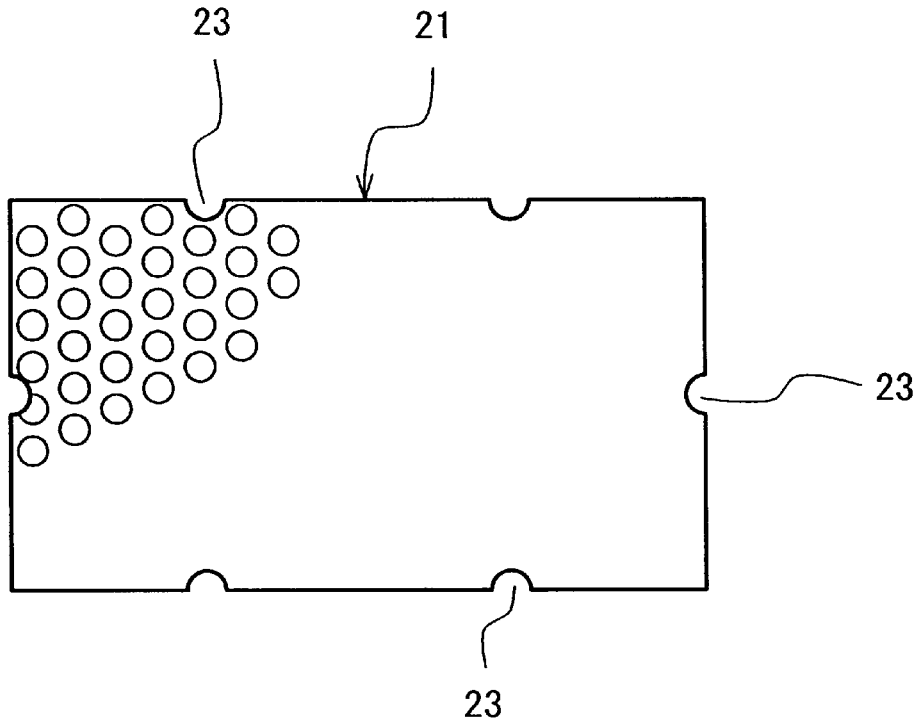
FIG. 6 is a plan view of a further example of a cushioning member according to this invention.

FIG. 5 is a perspective view of a cushioning member 21 formed by laminating sheet-like cushioning materials and integrally connecting them to each other and FIG. 6 is a plan view for the cushioning member 21.

As the material for the cushioning member 21, a plurality of elastic sheet-like materials such as those made of synthetic resin formed with an air layer, for example, an air-sealed sheet-like material (Trade name: Aircap), or elastic sheet-like material made of foamed material are used. A plurality of the cushioning materials 22 are laminated, and a portion of the lateral sides at which the lamination face is exposed is fused from the uppermost layer to the lowermost layer on the side at the lateral sides thereby continuously connecting the materials. Since the cushioning material 22 is formed of the soft sheet-like member of synthetic resin, it has such a melting property of being melted easily upon heating under a temperature, and the molten surfaces at the periphery are connected and fused to each other by melting.

For the melting, a metal member of a round bar or other appropriate shape is heated (red-hot stick) and applied to the laminated lateral side of the cushioning material 22. The cushioning material 22 is melted at the portion where the heated member is applied and a concave portion 23 of a shape conforming the outer profile of the portion applied with the heated member is formed. Since the portion is melted, vertically stacked cushioning materials 22 are connected by melting to each other to form the cushioning member 21.

For forming the concave portion 23, since it may suffice that the stacked cushioning materials 22 are integrally connected to each other, several concave portions 23 may be formed on the exposed lateral side as shown in FIG. 5 and FIG. 6.

Example 3 is particularly effective for the cushioning member 21 of a relatively small block.

Figure 7:
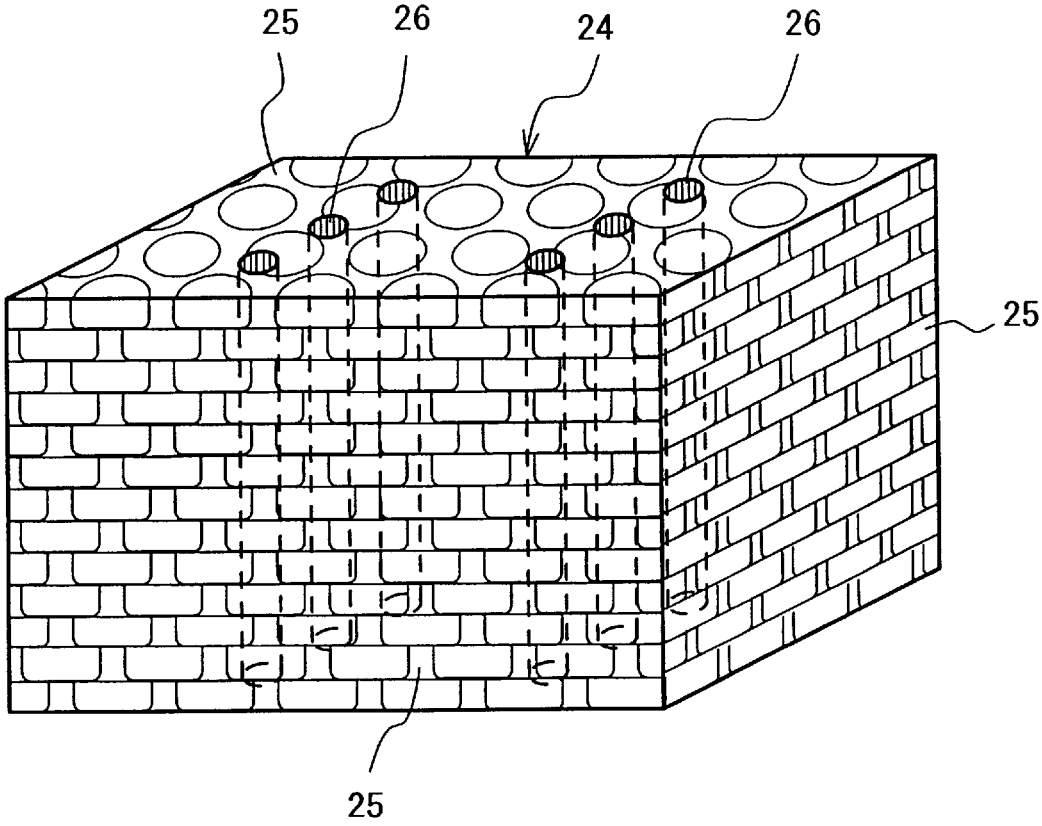
FIG. 7 is a perspective view of a further example of a cushioning member according to this invention.
Figure 8:
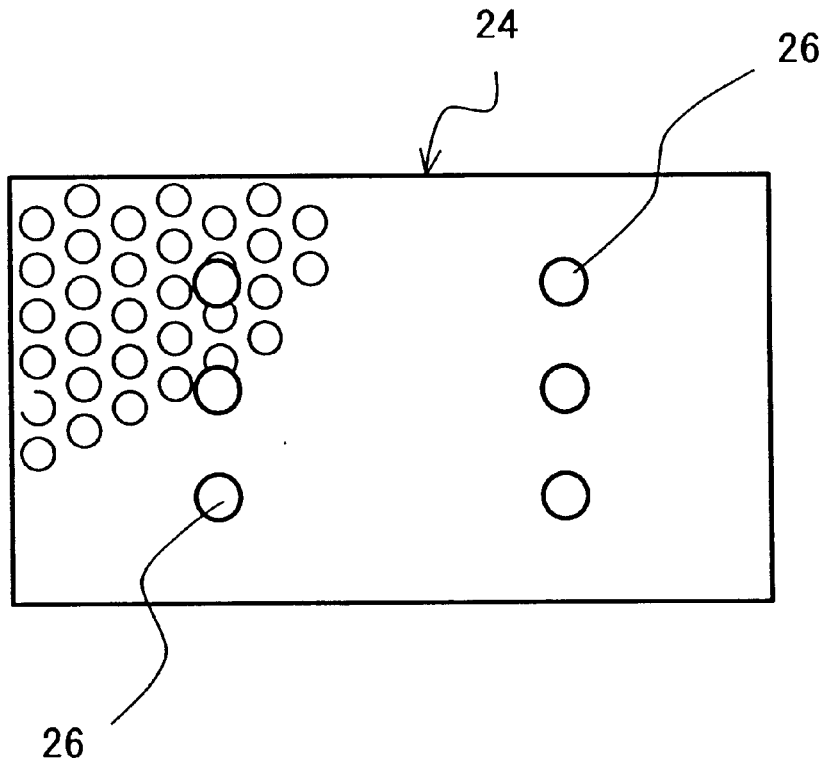
FIG. 8 is a plan view of a further example of a cushioning member according to this invention.

In Example 4, FIG. 7 is a perspective view showing a cushioning member 24 of a further example of this invention formed by laminating sheet-like cushioning materials and integrally connecting them to each other and FIG. 8 is a plan view of the cushioning member 24.

As the material for the cushioning member 24, like Example 3 described above, a plurality of elastic sheet-like materials are used such as those made of synthetic resin formed with an air layer, for example, an air-sealed sheet-like material (Trade name: Aircap), or elastic sheet-like material made of foamed material. A plurality of sheet-like synthetic resin cushioning materials 25 are laminated and fused along through holes passing through from the uppermost layer to the lowermost layer in the laminate by which the cushioning materials are integrally connected to each other. Since the cushioning material 25 is formed of the soft sheet-like member of synthetic resin, it has such a melting property of being melted easily upon heating, and the molten surfaces at the periphery are connected and fused to each other by melting.

For the melting, a metal member of a round bar for like other appropriate shape is heated (red-hot stick), in the same manner as described above, and the member is inserted vertically in perpendicular to the lamination face from the upper surface or the lower surface of the cushioning member 25 to the opposite side. The cushioning material 25 inserted with the heated member is melted at that portion to form a through hole 26 of a shape conforming the outer shape of the heated member. Since the portion is melted, the cushioning materials 25 stacked vertically along the molten surface are connected with each other.

Since it may suffice that the stacked cushioning materials 25 are connected with each other at the melted portions, several through holes 26 may be disposed in a well balanced distribution as shown in FIG. 7 and FIG. 8.

In Example 4 described above, since the cushioning materials are connected with each other at the central portion, this example is particularly effective for the cushioning member 24 of a relatively large block.

Example 5 is discussed hereinafter. In Example 3 described above, a metal member of a round bar or like other appropriate shape is heated (red-hot stick), and is applied to the laminated lateral side of the cushioning materials 22 to melt the applied portion thereby connecting vertically stacked cushioning materials 22 with each other. On the other hand, in Example 4, the heated member as described above is heated and inserted from the upper surface or the lower surface of the cushioning materials 25 to the opposite surface in the vertical direction perpendicular to the lamination face by which the cushioning materials 25 are melted along the through hole 26 in which the heated member is inserted and vertically stacked cushioning materials 25 are connected by the melting with each other.

In a cushioning member of a relatively large size, the central portion thereof is fused as in Example 4. However, since the periphery is not connected, the lamination face may possibly be defoliated from the periphery. Then, the worry can be prevented by the combined use of the means in Example 3 for connecting the materials to each other on the lateral side.

Therefore in Example 5, a cushioning member integrally connected at the inside of the central portion and the peripheral portion can be obtained.

In Examples 3, 4 and 5 described above, sheet-like cushioning materials used so far individually as the cushioning material are stacked in plurality and they-can be connected instantaneously by fusing to obtain a single flexible cushioning material of a predetermined thickness and a thick cushioning member can be obtained at a reduced cost.

Further, even when the size of the cushioning member is large, since the central portions can be connected instantaneously and easily to each other, the examples can cope with any size of cushioning members.

Further, when unevenness is present on the lamination face of the sheet-like cushioning materials after use, to make adhesion difficult, they can be connected efficiently to facilitate re-use by adopting the connection means of this invention.

In Example 6 of this invention, a flexible sheet-like cushioning member is adopted, in which upper and lower layers are formed of upper and lower soft sheets, an intermediate layer formed by the upper and lower layers is defined as an air layer, and the air layer is properly partitioned by soft sheet-like side walls for connecting the upper layer and the lower layer, to form a plurality of small spaces.

Accordingly, a cushioning member 31 (FIG. 9) flexible as a whole is formed with a plurality of air layers each surrounded with upper and lower sheets formed of a soft material and side walls also formed of a soft material.

Figure 9:
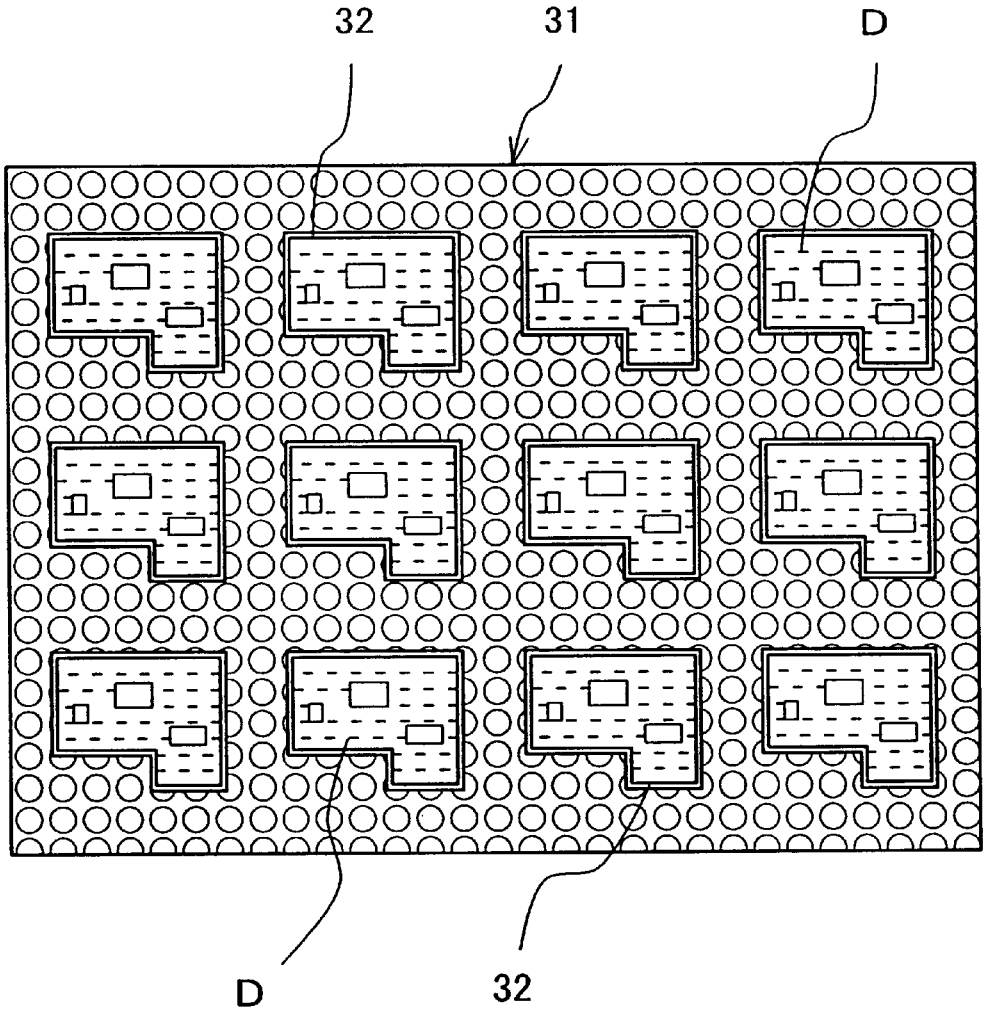
FIG. 9 is a plan view of a further example showing a state of a product contained in a cushioning member according to this invention;.

In this invention as shown in FIG. 9, a portion of the cushioning member 31 is collapsed to form concave portions 32 each at a predetermined distance at an appropriate number of portions, and the concave portion 32 is used as a space for containing relatively thin plate-like product D such as substrates for electronic parts.

In the concave portion 32, the air layer as the intermediate layer is collapsed by pulling a portion of the cushioning member by a vacuum pulling machine or the like to form a concave portion 32 of an appropriate shape.

Further, the concave portion 32 can easily be formed into a size conforming to the outer shape of an article such as a substrate for electronic parts to be contained and, accordingly, a concave portion corresponding to the size of the product D is formed. So long as the product D has a substantially plate-like shape, a concave portion 32 corresponding to the size of the product D can be formed in the cushioning member 31 irrespective of the outer shape of the product. Substrates for electronic parts are contained in the concave portions 32.

In the concave portion 32, the air layer is collapsed, since the upper and lower sheets and side walls constituting the air layer are formed of the soft material, and the concave portion 32 constitutes a portion having a sufficient cushioning function where the soft materials are stacked in a plurality of layers even when the air layer is collapsed.

Figure 10:
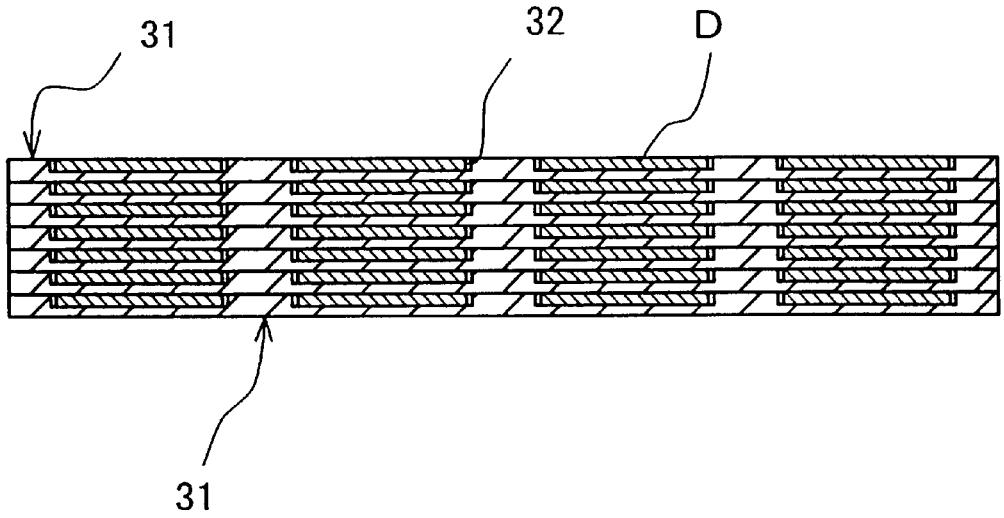
FIG. 10 is a side elevational cross sectional view of an example showing a state of products contained in cushioning members according to this invention and laminating them.

FIG. 10 shows a state where products D such as substrates for electronic parts are contained in concave portions 32 of flexible cushioning members 31 and they are stacked into a laminate. The cushioning members 31 can contain substantially plate-like products D such as substrates for electronic parts at a predetermined distance with no mutual contact of them and can attain the function as the cushioning members.

When they are contained in a separate containing container in the state described above, transportation is possible without transmission of direct impact shocks to the products D sensitive to impact shocks.

When the cushioning member of this invention is used, for example, at the uppermost stacked portion with no disposition of the products, the member can provide by itself the cushioning function.

In Example 6 described above, since concave portions are formed at appropriate positions of the flexible cushioning member and substantially plate-like products D are contained in the concave portions, the products D can be contained, as well as cushioning function for the products D can be attained.

Further, since the concave portion can be formed easily substantially to an identical outer shape of the products D, the plate-like products D can be prevented from movement in the forward-to-backward direction and right-to-left direction by merely disposing predetermined products D at the portions. Further, when the cushioning members containing the products D are stacked, this also results in a vertically constraining force, whereby the product D does not pop out of the concave portion and the cushioning function can be obtained.

Furthermore, since the function as the cushioning means can be obtained by the cushioning member, in addition to the partitioning containment of the products D, it is possible to provide a cushioning member which is reduced at a cost and capable of effectively containing the products D.

Furthermore, since the member is flexible, it can be easily folded or crumpled and can be utilized also as a usual cushioning member. Furthermore, once used cushioning member can be utilized again.

In example 7 of this invention, a laminate of sheet-like cushioning materials made of synthetic resin is formed by stacking cushioning materials of different size while making the number of sheets different to form unevenness and connecting the sheet-like cushioning materials to each other, to obtain a cushioning member with unevenness having a predetermined thickness and a container also serving for cushioning.

Figure 11:
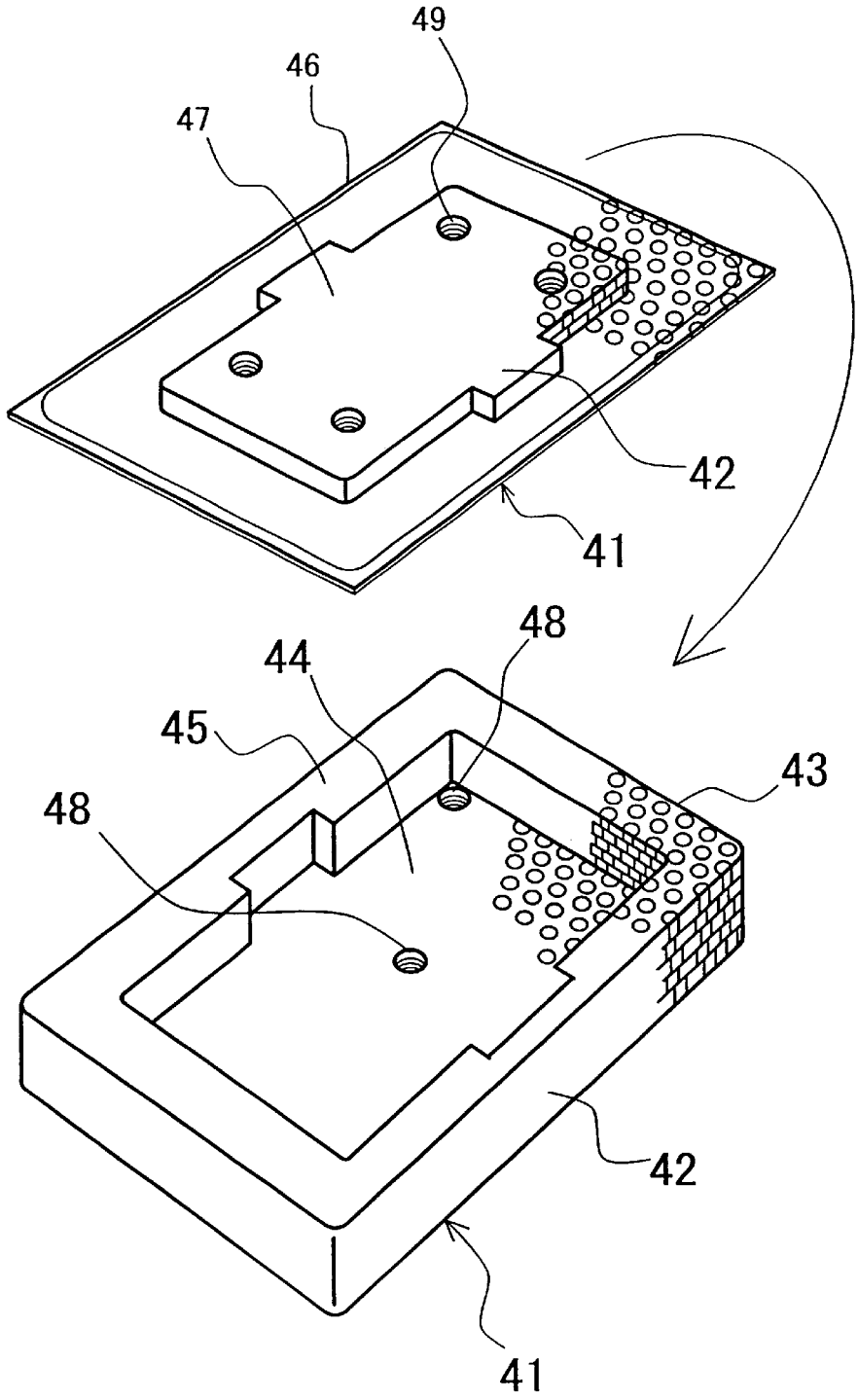
FIG. 11 is a perspective view of a further example of a container also serving for cushioning using a cushioning member according to this invention as a container.
Figure 12:
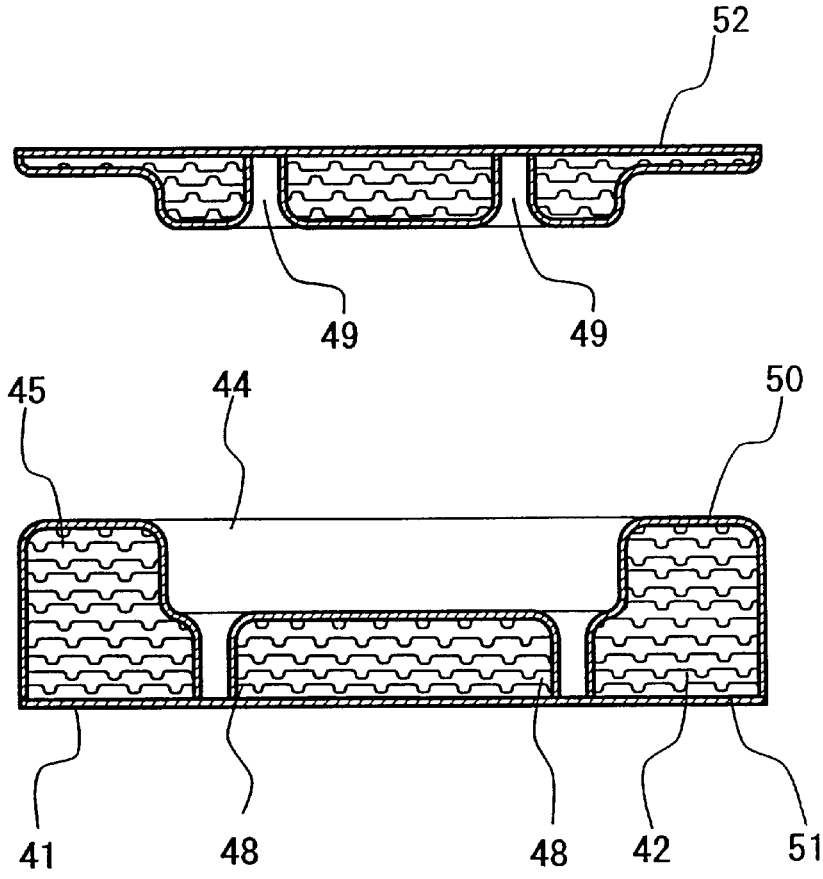
FIG. 12 is a cross sectional view of a further example of a container also serving for cushioning using a cushioning member according to this invention as a container.

FIG. 11 is a perspective view of a cushioning member 41 formed by laminating sheet-like cushioning materials and integrally connecting them to each other and FIG. 12 is a cross sectional view thereof.

As the material for the cushioning member 41, a plurality of elastic sheet-like materials such as those made of synthetic resin formed with an air layer, for example, an air-sealed sheet-like material (Trade name: Aircap), or elastic sheet-like material made of foamed material are used.

When the laminate is formed, a plurality of cushioning materials 42 of different sizes are laminated while making the number of stacked sheets different. That is, they are laminated with less number in a portion where a concave 44 as a containing portion 43 is formed and with a more number of sheets in a convex portion such as a protrusion 47 formed to a side wall 45 or a central portion of a lid 46.

Through holes 48 and 49 are formed, respectively, from the uppermost layer to the lowermost layer for the containing portion 43 and the lid 46 formed by laminating a plurality of the cushioning materials 42. The through holes 48 and 49 are formed so as to be distributed in appropriate positions on the containing portion 43 and the lid 46.

The periphery or the surface and the lateral side of the laminated cushioning member 41 are covered with a thin sheet member 50. In this case, the inner wall surfaces of the through holes 48 and 49 are also covered with the thin sheet member 50.

The periphery of the cushioning member 41 and the inner wall surface of the through holes 48 and 49 are covered by pulling the thin sheet member 50 disposed to the upper layer toward the lower layer by a vacuum pulling machine, by which the entire exposed surfaces of the cushioning material 41 including the inner wall surface of the through holes 48 and 49 can be covered.

A product is contained in the concave 44 and it is contained while being pressed from above by a protrusion 47 formed to the lid 46.

Further, sheet members 51 and 52 such as made of somewhat thick synthetic resin sheet, paper sheet, cloth, woven fabric or non-woven fabric can be attached to at least one surface of the containing portion 43 and the lid 46 for maintaining the outer profile thereof.

In Example 7 described above since flexible cushioning materials are stacked in plurality sheets or blocks, and the periphery or the surface and the lateral side thereof and the inner wall surface of the through holes are covered with a sheet member, it is possible to obtain a container also serving as a cushioning material with no positional displacement between each of the cushioning materials and being covered at the exposed surface with the sheet member.

What is claimed is:

1. A container for a product which also serves for cushioning the product, the container being defined by a cushioning material formed by stacking a plurality of sheet-like cushioning materials of different size into a laminate having an uneven shape which defines a concave portion, said laminate having an upper layer, a lower layer and an outer laminate periphery defining an outer container periphery of said container, forming through holes passing from said upper layer to said lower layer in the laminate wherein each said through hole has an inner wall surface, covering the outer laminate periphery of the laminate and the inner wall surface of the through holes with a sheet-like member and using the concave portion as a space for containing the product therein.

2. A container as defined in claim 1, wherein the laminate defines a lid portion and a separate containing portion.

3. A container as defined in claim 2, wherein said containing portion includes said concave portion defined therein.

4. A container as defined in claim 1, wherein said laminate defines a lid portion and a containing portion, said lid portion and said containing portion being joined together by a bendable connection portion wherein said lid portion is foldable over said containing portion to enclose the product therebetween.

5. A container for containing and cushioning an article, the container having an article containing portion defined by a plurality of cushioning layers of sheet-like cushioning materials which are stacked into a laminate wherein said cushioning layers have different sizes in plan view such that the number of cushioning layers at one location on said laminate varies from the number of cushioning layers at another location of said article containing portion such that said article containing portion has an uneven shape in which at least a recessed portion is formed to receive said article, providing upper and lower layers of a cover material which cover and conform to the shape of the cushioning layers and connect said upper and lower layers together at least about a periphery of said article containing portion to secure said cushioning layers together, the article containing portion including through holes which pass from said upper layer to said lower layer, wherein an inner wall surface of the through holes is covered by said cover material.

6. A container as defined in claim 5, wherein said cushioning materials are fused together along said inner wall surface of said through holes.

7. A container as defined in claim 5, wherein said container includes a lid portion which removably fits onto and covers said article containing portion.

8. A container as defined in claim 7, wherein said lid portion is formed by providing sheet-like cushioning material that is covered by upper and lower layers of a lid cover material wherein said upper and lower layers of said lid cover material are connected together at least about a periphery of said lid portion.

9. A container as defined in claim 8, wherein a plurality of cushioning layers of said cushioning material are stacked to form said lid portion wherein said cushioning layers have different sizes and the number of cushioning layers varies across a thickness of said lid portion such that said lid portion has an uneven shape.

10. A container for containing and cushioning an article, the container having an article containing portion and a lid portion which fits onto said article containing portion, at least one of said article containing portion and said lid portion being defined by a plurality of cushioning layers of sheet-like cushioning materials which are stacked into a laminate wherein said cushioning layers have different sizes in plan view such that the number of cushioning layers at a first location on said laminate varies from the number of cushioning layers at a second location on said one of said article containing portion and said lid portion so as to define an uneven shape defined by portions with a first thickness at said first location and a thicker second thickness at said second location, providing upper and lower layers of a cover material which cover and conform to the shape of the cushioning layers, and connecting said upper and lower layers together at least about a periphery of the cushioning layers to secure said cushioning layers together, the article containing portion including through holes which pass from said upper layer to said lower layer, wherein an inner wall surface of the through holes is covered by said cover material.

11. A container as defined in claim 10, wherein said article containing portion and said lid portion are formed separate from each other.

12. A container as defined in claim 10, wherein said lid portion and said article containing portion are joined together by a bendable connection portion wherein said lid portion is foldable over said article containing portion to enclose the article therebetween.

13. A container as defined in claim 10, wherein said article containing portion has a raised exterior wall defined by said portion having said second thickness and a recessed portion is defined within said walls by said portion having said first thickness, said recessed portion being formed to receive an article therein.

* * * * *